US006209829B1

(12) United States Patent
Yu

(10) Patent No.: US 6,209,829 B1
(45) Date of Patent: Apr. 3, 2001

(54) GUITAR STAND

(76) Inventor: Ming-Ti Yu, 122-5, Jun Liao Rd., Feng Yuan, Taichung Hsien (TW)

( * ) Notice: Subject to any disclaimer, the term of this patent is extended or adjusted under 35 U.S.C. 154(b) by 0 days.

(21) Appl. No.: 09/632,198

(22) Filed: Aug. 2, 2000

(51) Int. Cl.[7] ..... A47F 5/00

(52) U.S. Cl. ..... 248/122.1; 248/125.8; 248/161; 248/166; 248/185.1; 84/453

(58) Field of Search ..... 248/166, 176.1, 248/176.3, 125.1, 125.8, 161, 122.1, 185.1; 84/453

(56) References Cited

U.S. PATENT DOCUMENTS 5,375,497 * 12/1994 Pirchio et al. ..... 84/453 X
5,454,473 * 10/1995 Hennessey ..... 211/85.6
6,127,612 * 10/2000 Yu ..... 84/453 X

* cited by examiner

*Primary Examiner*—Anita M. King
*Assistant Examiner*—Korie H. Chan

(57) ABSTRACT

A guitar stand has a tripod device, a first adjustment device, a second adjustment device, a lower pipe, an upper pipe, a bracket device, and a clamping device. The first adjustment device is disposed on the tripod device. The bracket device is disposed on the first adjustment device. The first adjustment device receives a lower portion of the lower pipe. The second adjustment device receives an upper portion of the lower pipe and a lower portion of the upper pipe. The clamping device has a T-shaped joint receiving an upper portion of the upper pipe.

4 Claims, 7 Drawing Sheets

GUITAR STAND

BACKGROUND OF THE INVENTION

The present invention relates to a guitar stand. More particularly, the present invention relates to a guitar stand which can be folded into a compact configuration.

A conventional guitar stand can be detached into several parts. However, it is cumbersome to assemble the conventional guitar stand after the conventional guitar stand can is detached.

SUMMARY OF THE INVENTION

An object of the present invention is to provide a guitar stand which can be folded into a compact configuration.

Another object of the present invention is to provide a guitar stand which can be operated easily.

Accordingly, a guitar stand comprises a tripod device, a first adjustment device, a second adjustment device, a lower pipe, an upper pipe, a bracket device, and a clamping device. The lower pipe has an outer recess. The upper pipe has an outer groove. The first adjustment device is disposed on the tripod device. The bracket device is disposed on the first adjustment device. The first adjustment device receives a lower portion of the lower pipe. The second adjustment device receives an upper portion of the lower pipe and a lower portion of the upper pipe. The clamping device has a T-shaped joint receiving an upper portion of the upper pipe and an insertion pipe. A connection mount is connected to the insertion pipe. Two arc plates are disposed on the connection mount. The tripod device has a positioning seat, three rods, and a corrugation tube. The corrugation tube is disposed on the positioning seat. The positioning seat has three periphery holes, three lower notches matching the periphery holes, and three inner blocks. Each of the inner blocks has an upper notch. The rod is inserted in the respective periphery hole of the positioning seat. A corrugation tube is disposed on the positioning seat. The corrugation tube receives the lower pipe. The first adjustment device has a first sleeve, a first main body disposed on the first sleeve, a first lateral pipe connected to the first main body, a first packing block, a first washer, and a first button. The first lateral pipe has an inner recess. The first main body has a first hollow collar and a first square block. The first hollow collar has a first inner protrusion and a first through hole. The first square block has a first hexagonal hole. A first screw rod passes through the first hexagonal hole of the first square block, the first packing block, the first washer, and the first button. The corrugation tube is inserted in the first sleeve. The lower pipe is inserted in the first through hole of the first hollow collar. The bracket device has an insertion tube inserted in the first lateral pipe, a connection seat connected to the insertion tube, and two arm plates disposed on the connection seat. A hollow interior is formed in the first lateral pipe to communicate with the inner recess of the first lateral pipe. The insertion tube has a protruded block inserted in the hollow interior of the first lateral pipe via the inner recess of the first lateral pipe. An elastic cushion is disposed on the connection seat. The second adjustment device has a second sleeve, a second main body disposed on the second sleeve, a second packing block, a second washer, and a second button. The second main body has a second hollow collar and a second square block. The second hollow collar has a second inner protrusion and a second through hole. The second square block has a second hexagonal hole. A second screw rod passes through the second hexagonal hole of the second square block, the second packing block, the second washer, and the second button. The lower pipe is inserted in the second sleeve. The upper pipe is inserted in the second through hole of the second hollow collar.

DETAILED DESCRIPTION OF THE INVENTION

Figure 1:
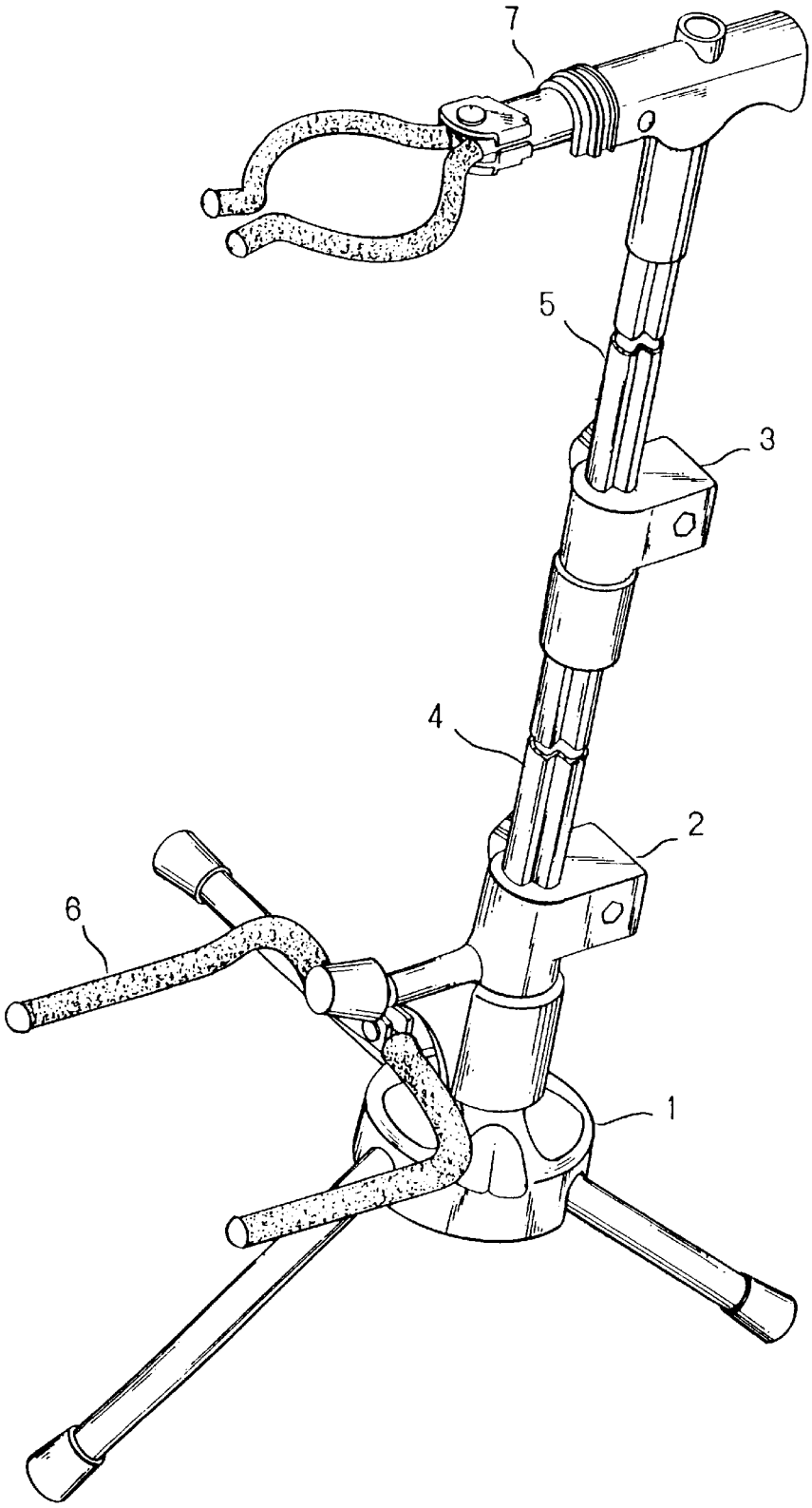
FIG. 1 is a perspective assembly view of a guitar stand of a preferred embodiment in accordance with the present invention.
Figure 2:
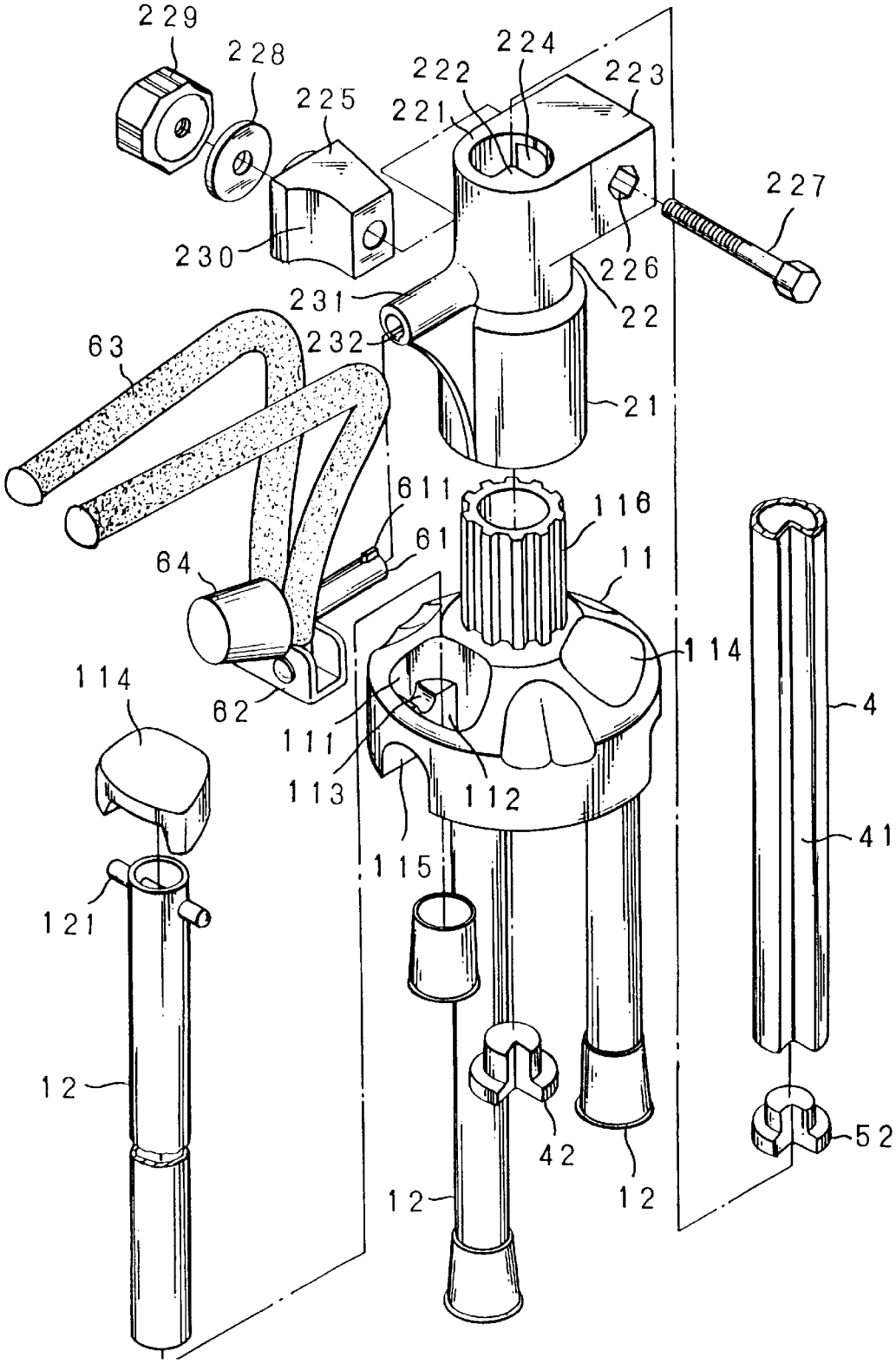
FIG. 2 is a perspective exploded view of a lower portion of a guitar stand of a preferred embodiment in accordance with the present invention.
Figure 3:
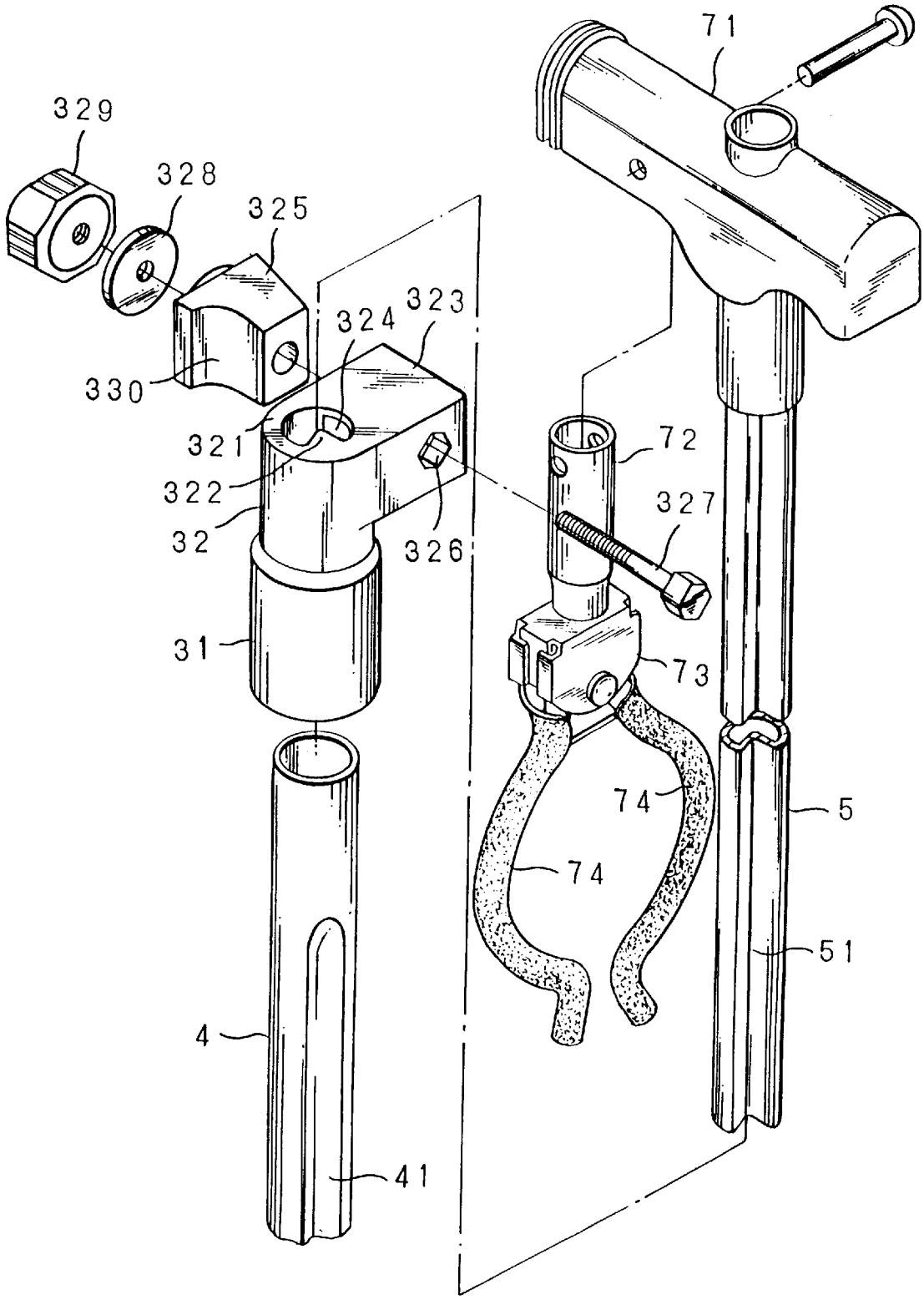
FIG. 3 is a perspective exploded view of an upper portion of a guitar stand of a preferred embodiment in accordance with the present invention.
Figure 4:
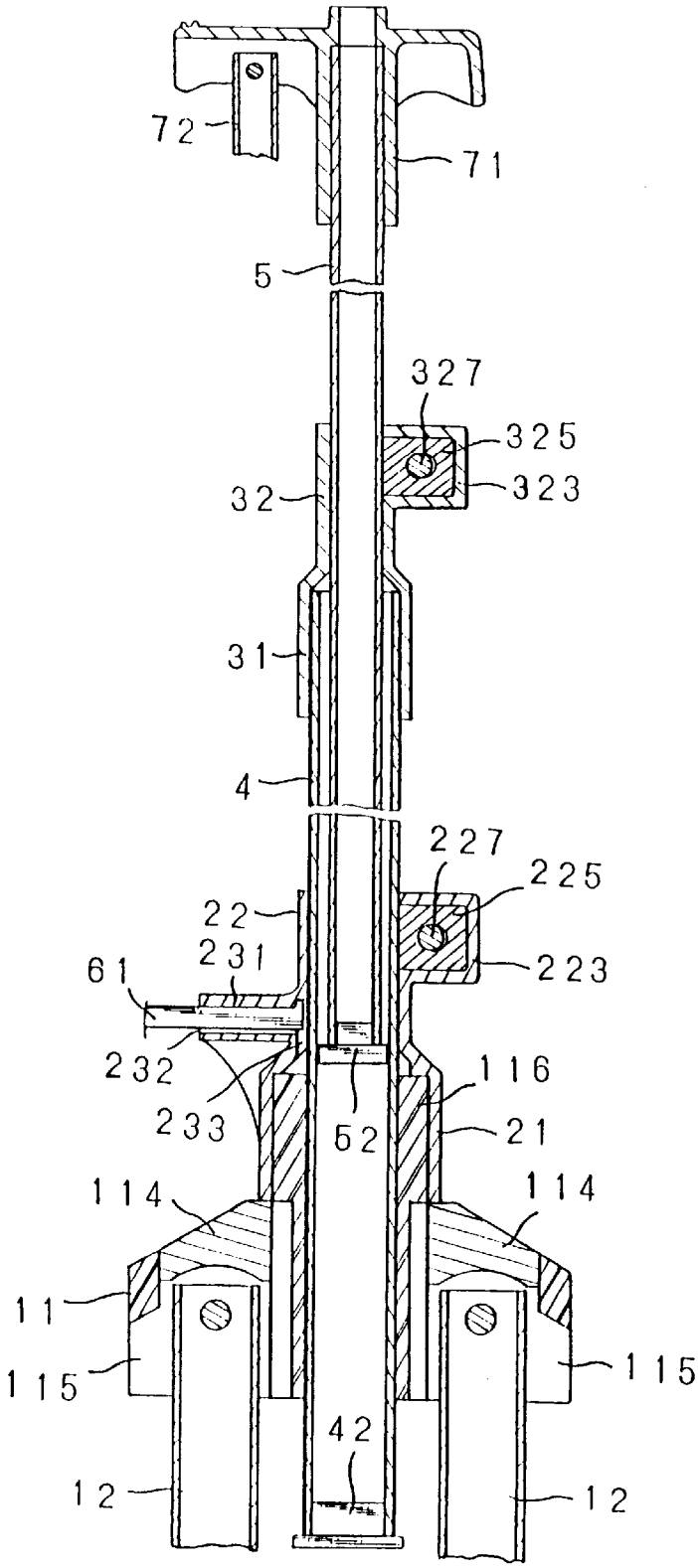
FIG. 4 is a sectional schematic view illustrating a tripod device of a guitar stand of a preferred embodiment is folded.
Figure 5:
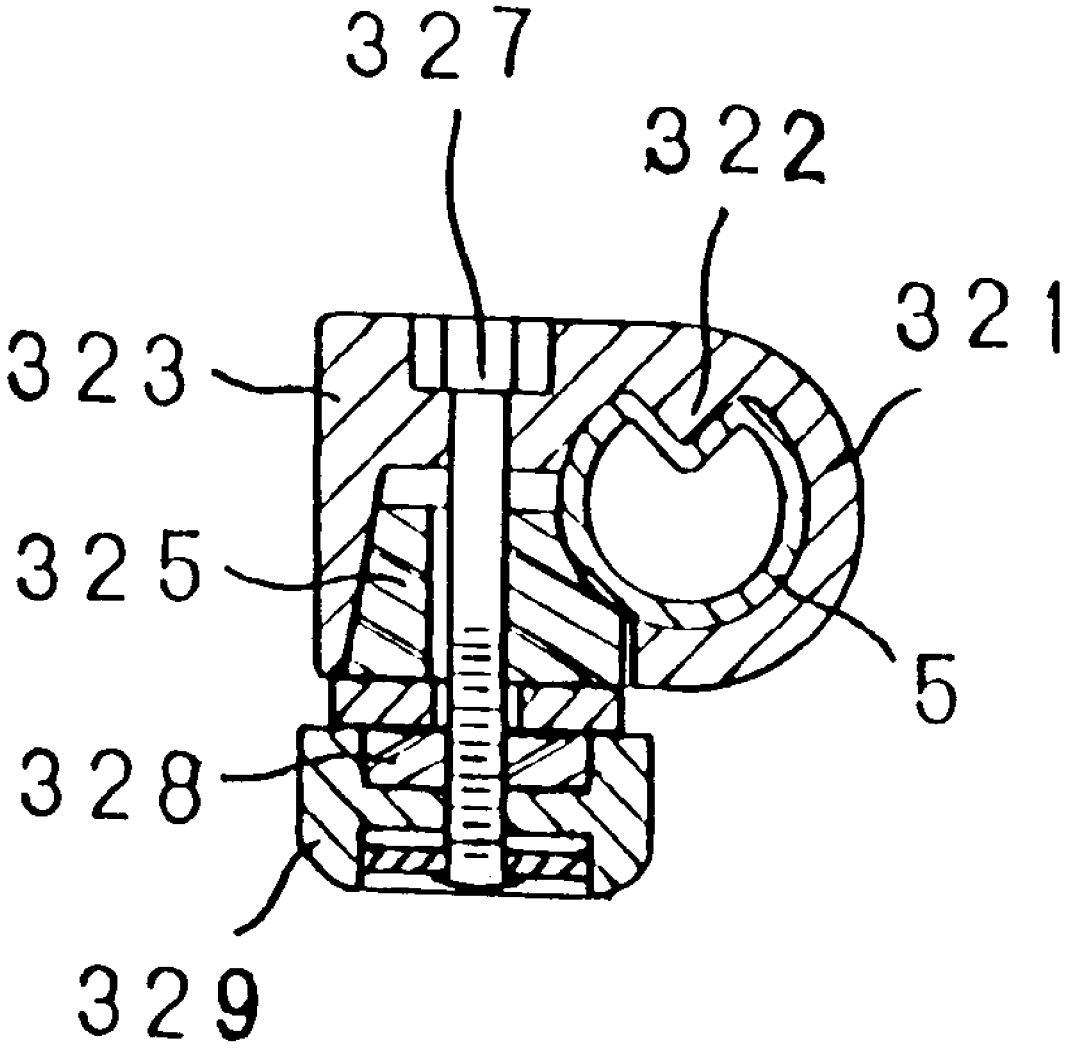
FIG. 5 is a sectional view of a second adjustment device of a guitar stand of a preferred embodiment.
Figure 6:
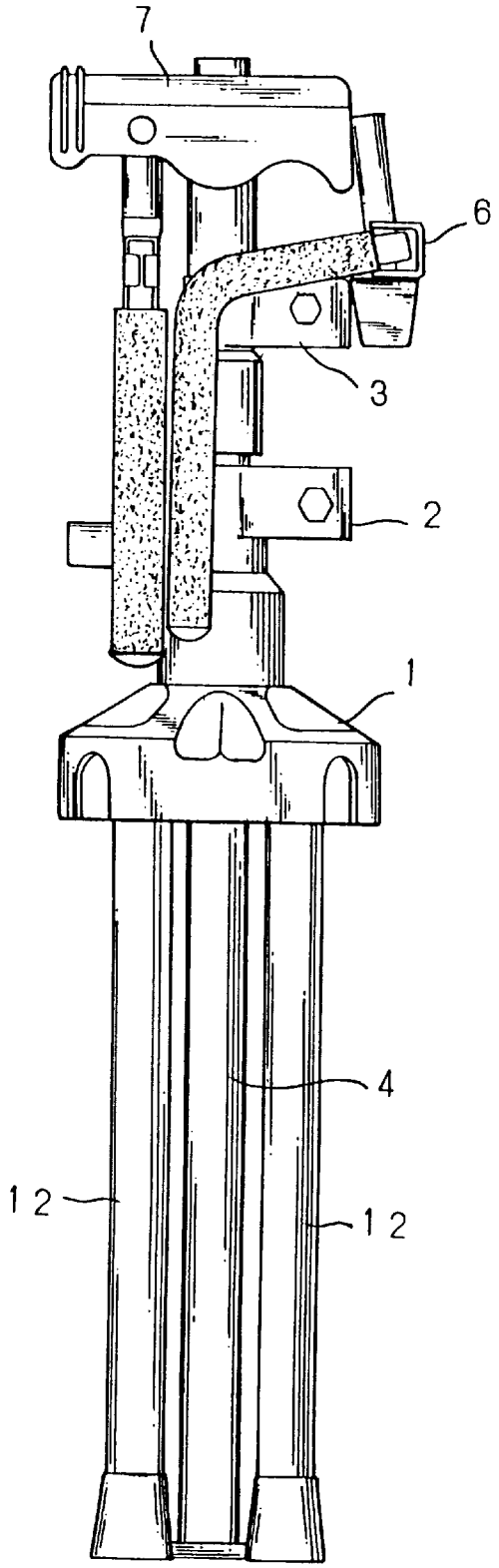
FIG. 6 is a perspective schematic view illustrating a guitar stand of a preferred embodiment is folded into a compact configuration.

Referring to FIGS. 1 to 6, a guitar stand comprises a tripod device i, a first adjustment device 2, a second adjustment device 3, a lower pipe 4, an upper pipe 5, a bracket device 6, and a clamping device 7.

The lower pipe 4 has an outer recess 41. The upper pipe 5 has an outer groove 51.

A first plug 42 is inserted in a lower end of the lower pipe 4. A second plug 52 is inserted in a lower end of the upper pipe 5.

The first adjustment device 2 is disposed on the tripod device 1. The bracket device 6 is disposed on the first adjustment device 2.

The first adjustment device 2 receives a lower portion of the lower pipe 4.

The second adjustment device 3 receives an upper portion of the lower pipe 4 and a lower portion of the upper pipe 5.

The clamping device 7 has a T-shaped joint 71 receiving an upper portion of the upper pipe 5 and an insertion pipe 72.

A connection mount 73 is connected to the insertion pipe 72. Two arc plates 74 are disposed on the connection mount 73.

The tripod device 1 has a positioning seat 11, three rods 12, and a corrugation tube 116. The corrugation tube 116 is disposed on the positioning seat 11.

The positioning seat 11 has three periphery holes 111, three lower notches 115 matching the periphery holes 111, and three inner blocks 112. Each of the inner blocks 112 has an upper notch 113.

Each of the rods 12 has a shaft 121 disposed on an upper end of the respective rod 12. The rod 12 is inserted in the respective periphery hole 111 of the positioning seat 11. The upper notch 113 of the inner block 112 receives the respective shaft 121.

Three cover plates 114 cover the periphery holes 111 of the positioning seat 11.

A corrugation tube 116 is disposed on the positioning seat 11. The corrugation tube 116 receives the lower pipe 4.

The first adjustment device 2 has a first sleeve 21, a first main body 22 disposed on the first sleeve 21, a first lateral pipe 231 connected to the first main body 22, a first packing block 225, a first washer 228, and a first button 229.

The first lateral pipe 231 has an inner recess 232.

The first main body 22 has a first hollow collar 221 and a first square block 223.

The first hollow collar 221 has a first inner protrusion 222 and a first through hole 224.

The first square block 223 has a first hexagonal hole 226.

A first screw rod 227 passes through the first hexagonal hole 226 of the first square block 223, the first packing block 225, the first washer 228, and the first button 229.

The corrugation tube 116 is inserted in the first sleeve 21.

The lower pipe 4 is inserted in the first through hole 224 of the first hollow collar 221.

The bracket device 6 has an insertion tube 61 inserted in the first lateral pipe 231, a connection seat 62 connected to the insertion tube 61, and two arm plates 63 disposed on the connection seat 62.

A hollow interior 233 is formed in the first lateral pipe 231 to communicate with the inner recess 232 of the first lateral pipe 231.

The insertion tube 61 has a protruded block 611 inserted in the hollow interior 233 of the first lateral pipe 231 via the inner recess 232 of the first lateral pipe 231.

An elastic cushion 64 is disposed on the connection seat 62.

The second adjustment device 3 has a second sleeve 31, a second main body 32 disposed on the second sleeve 31, a second packing block 325, a second washer 328, and a second button 329.

The second main body 32 has a second hollow collar 321 and a second square block 323.

The second hollow collar 321 has a second inner protrusion 322 and a second through hole 324.

The second square block 323 has a second hexagonal hole 326.

A second screw rod 327 passes through the second hexagonal hole 326 of the second square block 323, the second packing block 325, the second washer 328, and the second button 329.

The lower pipe 4 is inserted in the second sleeve 31. The upper pipe 5 is inserted in the second through hole 324 of the second hollow collar 321.

Figure 7:
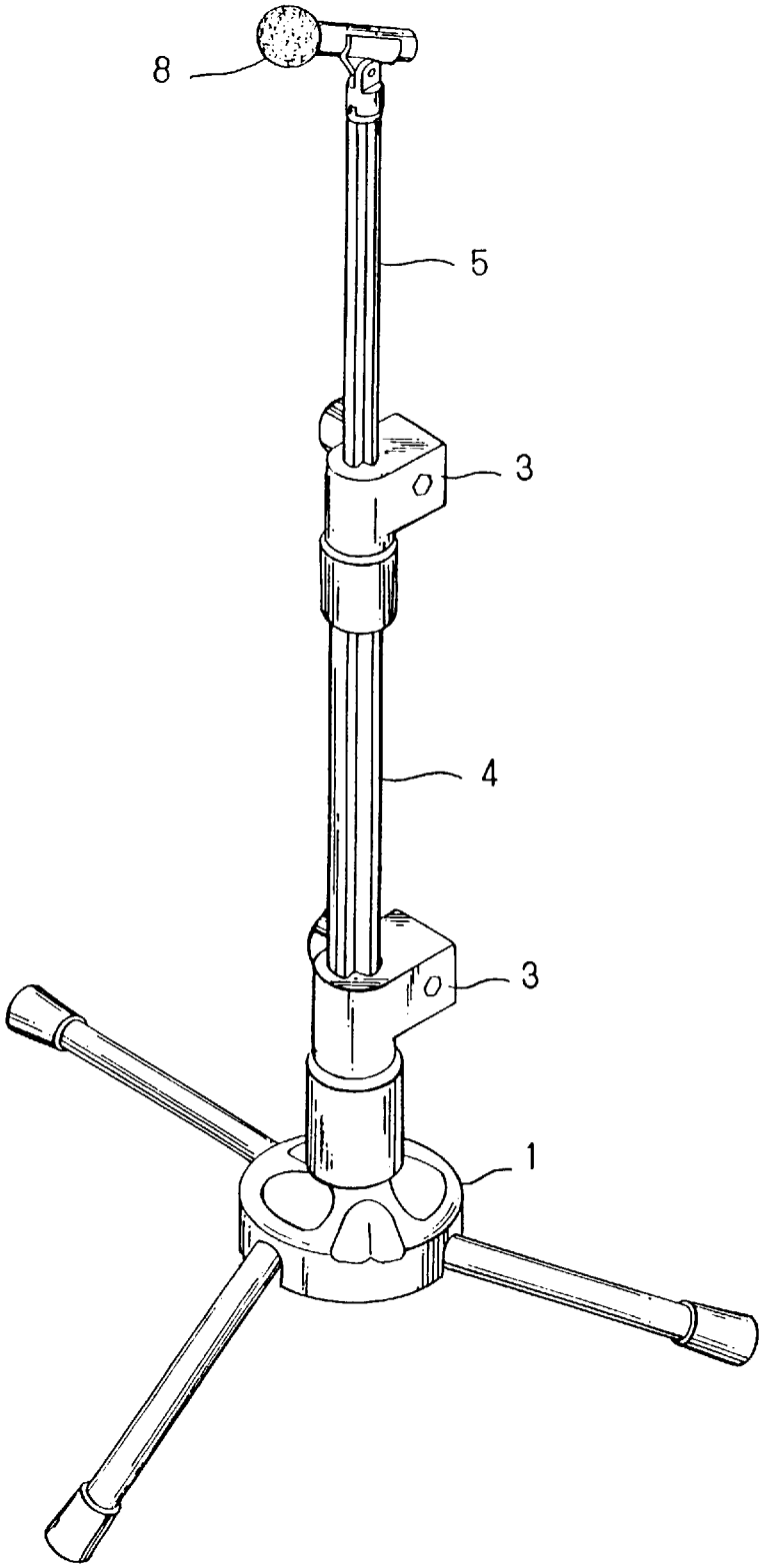
FIG. 7 is a perspective assembly view of a guitar stand of a preferred embodiment and a microphone without a clamping device.

Referring to FIG. 7, a microphone 8 is disposed on an upper end of the upper pipe 5 to replace the clamping device 7.

The invention is not limited to the above embodiment but various modification thereof may be made. Further, various changes in form and detail may be made without departing from the scope of the invention.

I claim:

1. A guitar stand comprising:

a tripod device, a first adjustment device, a second adjustment device, a lower pipe, an upper pipe, a bracket device, and a clamping device, the lower pipe has an outer recess, the upper pipe has an outer groove, the first adjustment device disposed on the tripod device, the bracket device disposed on the first adjustment device, the first adjustment device receiving a lower portion of the lower pipe, the second adjustment device receiving an upper portion of the lower pipe and a lower portion of the upper pipe, the clamping device having a T-shaped joint receiving an upper portion of the upper pipe and an insertion pipe, a connection mount connected to the insertion pipe, two arc plates disposed on the connection mount, the tripod device having a positioning seat, three rods, and a corrugation tube, the corrugation tube disposed on the positioning seat, the positioning seat having three periphery holes, three lower notches matching the periphery holes, and three inner blocks, each of the inner blocks having an upper notch, the rod inserted in the respective periphery hole of the positioning seat, the corrugation tube disposed on the positioning seat, the corrugation tube receiving the lower pipe, the first adjustment device having a first sleeve, a first main body disposed on the first sleeve, a first lateral pipe connected to the first main body, a first packing block, a first washer, and a first button, the first lateral pipe having an inner recess, the first main body having a first hollow collar and a first square block, the first hollow collar having a first inner protrusion and a first through hole, the first square block having a first hexagonal hole, a first screw rod passing through the first hexagonal hole of the first square block, the first packing block, the first washer, and the first button, the corrugation tube inserted in the first sleeve, the lower pipe inserted in the first through hole of the first hollow collar, the bracket device having an insertion tube inserted in the first lateral pipe, a connection seat connected to the insertion tube, and two arm plates disposed on the connection seat, a hollow interior formed in the first lateral pipe to communicate with the inner recess of the first lateral pipe, the insertion tube having a protruded block inserted in the hollow interior of the first lateral pipe via the inner recess of the first lateral pipe, an elastic cushion disposed on the connection seat, the second adjustment device having a second sleeve, a second main body disposed on the second sleeve, a second packing block, a second washer, and a second button, the second main body having a second hollow collar and a second square block, the second hollow collar having a second inner protrusion and a second through hole, the second square block having a second hexagonal hole, a second screw rod passing through the second hexagonal hole of the second square block, the second packing block, the second washer, and the second button, the lower pipe inserted in the second sleeve, and the upper pipe inserted in the second through hole of the second hollow collar.

2. The guitar stand as claimed in claim 1, wherein a first plug is inserted in a lower end of the lower pipe.

3. The guitar stand as claimed in claim 1, wherein a second plug is inserted in a lower end of the upper pipe.

4. The guitar stand as claimed in claim 1, wherein three cover plates cover the periphery holes of the positioning seat.

* * * * *